US006539952B2

(12) United States Patent
Itzkowitz

(10) Patent No.: US 6,539,952 B2
(45) Date of Patent: Apr. 1, 2003

(54) MEGASONIC TREATMENT APPARATUS

(75) Inventor: Herman Itzkowitz, Bala Cynwyd, PA (US)

(73) Assignee: Solid State Equipment Corp., Horsham, PA (US)

( * ) Notice: Subject to any disclaimer, the term of this patent is extended or adjusted under 35 U.S.C. 154(b) by 100 days.

(21) Appl. No.: 09/841,231

(22) Filed: Apr. 24, 2001

(65) Prior Publication Data

US 2001/0032657 A1 Oct. 25, 2001

Related U.S. Application Data

(60) Provisional application No. 60/199,501, filed on Apr. 25, 2000.

(51) Int. Cl.[7] ..... C25F 5/00

(52) U.S. Cl. ..... 134/1.3; 134/1; 134/2; 134/25.5; 134/32; 134/33; 134/34; 134/137; 134/144; 134/147; 134/149; 134/157; 134/184; 134/190; 134/196; 134/902; 310/327; 310/328; 310/323.06; 310/334; 310/340

(58) Field of Search ..... 134/1, 1.3, 2, 25.5, 134/32, 33, 34, 137, 144, 147, 149, 157, 184, 186, 190, 196, 902; 310/327, 328, 323.06, 334, 340

(56) References Cited

U.S. PATENT DOCUMENTS

| | | | | |
|---|---|---|---|---|
| 2,498,737 A | | 2/1950 | Holden | |
| 3,094,314 A | | 6/1963 | Kearney et al. | |
| 3,301,535 A | | 1/1967 | Brown | |
| 4,064,885 A | | 12/1977 | Dussault et al. | |
| 4,183,011 A | | 1/1980 | Massa | |
| 4,326,553 A | | 4/1982 | Hall | |
| 4,401,131 A | | 8/1983 | Lawson | |
| 4,501,285 A | | 2/1985 | Irwin et al. | |
| 4,804,007 A | | 2/1989 | Bran | |
| 4,869,278 A | * | 9/1989 | Bran | 134/184 |
| 5,156,174 A | | 10/1992 | Thompson et al. | |
| 5,355,048 A | | 10/1994 | Estes | |
| 5,365,960 A | | 11/1994 | Bran | |
| 5,368,054 A | | 11/1994 | Koretsky et al. | |
| 5,383,484 A | | 1/1995 | Thomas et al. | |
| 5,601,655 A | | 2/1997 | Bok et al. | |
| 5,625,249 A | | 4/1997 | Grant | |
| 5,672,212 A | | 9/1997 | Manos | |
| 5,762,084 A | | 6/1998 | Krusell et al. | |
| 5,849,091 A | | 12/1998 | Skrovan et al. | |
| 5,888,124 A | | 3/1999 | Lin et al. | |
| 5,908,509 A | | 6/1999 | Olesen et al. | |
| 5,927,308 A | | 7/1999 | Kim | |
| 5,950,645 A | | 9/1999 | Olesen et al. | |
| 5,996,594 A | | 12/1999 | Roy et al. | |
| 6,039,059 A | | 3/2000 | Bran | |
| 6,140,744 A | | 10/2000 | Bran | |
| 6,276,370 B1 | * | 8/2001 | Fisch et al. | 134/1.3 |

FOREIGN PATENT DOCUMENTS

| | | |
|---|---|---|
| JP | 61-16528 | 1/1986 |
| JP | 2-109333 | 4/1990 |
| JP | 4-206725 | 7/1992 |
| JP | 4-213827 | 8/1992 |
| JP | 5-175184 | 7/1993 |

* cited by examiner

*Primary Examiner*—Randy Gulakowski
*Assistant Examiner*—M. Kornakov
(74) *Attorney, Agent, or Firm*—Evelyn H. McConathy; Dilworth Paxson LLP

(57) ABSTRACT

The invention provides an apparatus and method for cleaning or etching wafers. The invention further provides a megasonic transducer designed to apply mechanical vibrations to a layer of fluid in contact with a wafer. The electromechanical transducer is housed in a quartz or sapphire lens which is chemically compatible with the layer of fluid, and sealed to protect the housing interior from fluids and chemical fumes. An electrical power source produces a signal that is sent to the transducer to generate a megasonic wave. The wave travels between the lens and the wafer, through the layer of fluid, dislodging small particles from the wafer which are then removed in the fluid stream. In one embodiment of the present invention, a wafer to be cleaned is placed on a rotatable support below a transducer assembly. A fluid is introduced through the transducer assembly to provide a layer of fluid between the lens and wafer. In a wafer etch application, the megasonic energy is used to enhance the etch rate on the surface of the wafer.

21 Claims, 3 Drawing Sheets

MEGASONIC TREATMENT APPARATUS

REFERENCE TO RELATED APPLICATIONS

This application claims priority to U.S. Provisional Application No. 60/199,501, filed Apr. 25, 2000.

FIELD OF THE INVENTION

The present invention relates to the processing of flat work pieces such as semiconductor wafers. More particularly, megasonic energy is applied to a thin layer of fluid directed to a wafer surface through an opening in a transducer faceplate, to clean or etch the wafer surface.

BACKGROUND OF THE INVENTION

Semiconductor devices are typically fabricated on a substrate in the form of a circular wafer of semiconductor material. Electronic devices and circuitry are fabricated on the semiconductor wafer using one or more available techniques, such as selective etching, photolithography, and vapor phase deposition.

During the fabrication of devices and circuitry on the semiconductor wafers, particulate matter accumulates on the wafer and migrates to where devices and circuitry are being fabricated. Particulate matter that remains on the wafer will cause defects in the devices and circuitry being fabricated on the wafer. Those defects can result in the production of defective electronic devices, reduce the number of functional units per wafer, and increase the cost of wafer production per unit. With the rapid technological advances in semiconductor production, electronic device geometries continue to diminish, and defects in semiconductor wafers, accordingly, have become more critical.

The established method to solve the particulate matter accumulation problem is to immerse the wafers in a fluid bath. The particles attached to the surface of the wafers are small and difficult to remove because they are within the boundary layer of the fluid bath. Accordingly, acoustic energy is added to the fluid bath to aid in breaking the particles loose from the wafer surface. The acoustic energy creates turbulence in the fluid, which effectively reduces the fluid boundary layer thickness. To avoid undesirable effects of cavitation within the fluid, sonic energies with frequencies above 0.5 megahertz (MHz) are used. The term "megasonic" is used to indicate that sonic energy is in the range of 0.5 to 2 MHz. The megasonic energy is commonly applied to the bottom of the tank.

However, fluid baths have seen limited success. To permit bulk handling for cost reasons, multiple wafers are placed in a carrier, or cassette, which is then placed in the fluid bath. With this approach, each wafer is exposed to a different level of sonic energy, often resulting in non-uniform cleaning of the wafers.

The drawbacks with the fluid baths and other developments in sonic wafer cleaners have led to cleaning devices that dispense cleaning fluid onto a single wafer, rotated on a spindle, with a focused sonic energy source, or transducer, located over the wafer to apply ultrasonic energy to the fluid. Cleaning systems of this type have been described, for example, in U.S. Pat. No. 4,064,885 (Dussault et al.), U.S. Pat. No. 4,401,131 (Lawson), and U.S. Pat. No. 4,501,285 (Irwin et al.), U.S. Pat. No. 5,368,054 (Koretsky et al.) and in Japanese patents 61-16528 and 4-213827.

However, that approach also has several drawbacks. First, the fluid used for cleaning is typically dispensed from a pump located independent from the transducer, and flows into a space between the wafer and the sonic source. Uniformity is improved, but due to the necessarily small active energy spot (limited by the size of the transducer) and the fairly high fluid flow requirements, cleaning times are long and consumption of cleaning solution is high.

Second, devices of that type do not provide an efficient way of controlling the energy density of the transducer. The rapid increase in the demand for a variety of electronic circuits on wafers, and for a variety of applications, has led to a concomitant demand for sonic cleaning devices that are able to remove particulate matter from wafers of various materials, with various devices and circuitry. To accommodate that variety, the cleaning device must be able to efficiently adjust the energy applied by the transducer to optimize its energy density for a particular type of wafer being cleaned or etched.

Finally, the transducer can be adversely affected by the cleaning chemicals used. Thus, the chemicals used and their concentrations in the fluid are typically very limited. At the same time, ultrasonic cleaning devices must be able to accommodate higher concentrations of chemicals to efficiently clean the wafers.

The present invention remedies the above disadvantages through, e.g., an improved distribution of the cleaning fluid, an improved transducer assembly, and a system for optimization of the sonic energy density.

SUMMARY OF THE INVENTION

The present invention provides a device and a method for treating wafers comprising, for example, an improved delivery of cleaning fluid, an improved transducer lens, and a system for optimization of the transducer energy density. The present invention thoroughly cleans or etches semiconductor material at a desired rate for economical processing thereof.

The present invention applies megasonic energy to clean the wafers by dislodging small particles from the wafer surface, without the use of a fluid tank. A preferred embodiment of the present invention provides an apparatus for treating, e.g., cleaning or etching, wafers, wherein the apparatus further comprises: a wafer support for supporting and rotating a wafer to be treated; a fluid supply port for directing a layer of fluid to the surface of the supported wafer; and an electromechanical transducer assembly for converting electrical signals into mechanical vibrations of a pre-selected megasonic frequency and wavelength and applying the vibrations to the surface of the supported wafer through the layer of fluid. The transducer assembly further comprises (i) a sealed lens having an interior which is bounded by a faceplate and a wall extending upward from the periphery of the faceplate, and a plurality of exterior surfaces, wherein at least one exterior surface of the faceplate portion of the lens comprises a planar fluid contact surface, and (ii) an electromechanical transducer which is located in the interior of the lens and placed in vibration transmitting contact with the faceplate, such that the vibrations are transmitted to the fluid contact surface. The faceplate comprises a material, which is inert with respect to the fluid and which has a thickness that is a multiple of the wavelength of the mechanical vibrations. The fluid supply port is located through a portion of the faceplate.

In another preferred embodiment, a method is provided for treating a wafer comprising: supporting and rotating a wafer to be treated on a wafer support, and directing a layer of fluid to the surface of the supported wafer through a fluid supply port, wherein the thickness of the layer of fluid on the supported wafer is a multiple of ½ wavelength of the mechanical vibrations in the fluid. This is followed by sending an electrical signal to an electromechanical transducer assembly, wherein the electrical signal is converted into mechanical vibrations of a pre-selected frequency and wavelength and applying the vibrations to the surface of the supported wafer through the layer of fluid, wherein the transducer assembly comprises (i) a sealed lens having an interior which is bounded by a faceplate and a wall extending upward from the periphery of the faceplate, and a plurality of exterior surfaces, wherein at least one exterior surface of the faceplate portion of the lens comprises a planar fluid contact surface, and (ii) an electromechanical transducer which is located in the interior of the lens and placed in vibration transmitting contact with the faceplate, such that the vibrations are transmitted to the fluid contact surface, wherein the faceplate comprises a material, which is inert with respect to the fluid and which has a thickness that is a multiple of the wavelength of the mechanical vibrations, and wherein the fluid supply port is located in a portion of the faceplate. Finally, the fluid layer in contact with the fluid contact surface is excited to effect the desired treatment on the wafer.

In addition, in the preferred embodiments of the invention, the lens material is a non-metal material preferably quartz or sapphire, wherein the thickness of the faceplate is equal to one and one half wavelengths of the mechanical vibration in the material.

As provided in the preferred embodiment of the invention, the electromechanical transducer assembly is supported from above by a cantilevered arm, wherein the arm moves the transducer assembly radially over a wafer on the wafer support to cover the entire wafer surface. Moreover, in this embodiment, the arm further includes height adjustment means, whereby adjusting the height of the fluid contact surface above the wafer controls thickness of the fluid layer on the wafer by multiples of one-half the wavelength of the mechanical vibrations in the fluid.

The fluid supply port in the preferred embodiment is located in the center of the transducer assembly and through the center of the faceplate.

The invention is applicable to cleaning and etching wafers in semiconductor fabrication operations, as well as to other operations in which megasonic energy is useful in treating other objects.

Additional objects, advantages and novel features of the invention will be set forth in part in the description and figures which follow, and in part will become apparent to those skilled in the art on examination of the following, or may be learned by practice of the invention.

DESCRIPTION OF THE DRAWINGS

The foregoing summary, as well as the following detailed description of the invention, will be better understood when read in conjunction with the appended drawings. For the purpose of illustrating the invention, there are shown in the drawings, certain embodiment(s) which are presently preferred. It should be understood, however, that the invention is hot limited to the precise arrangements and instrumentalities shown.

DESCRIPTION OF PREFERRED EMBODIMENTS OF THE INVENTION

Figure 1:
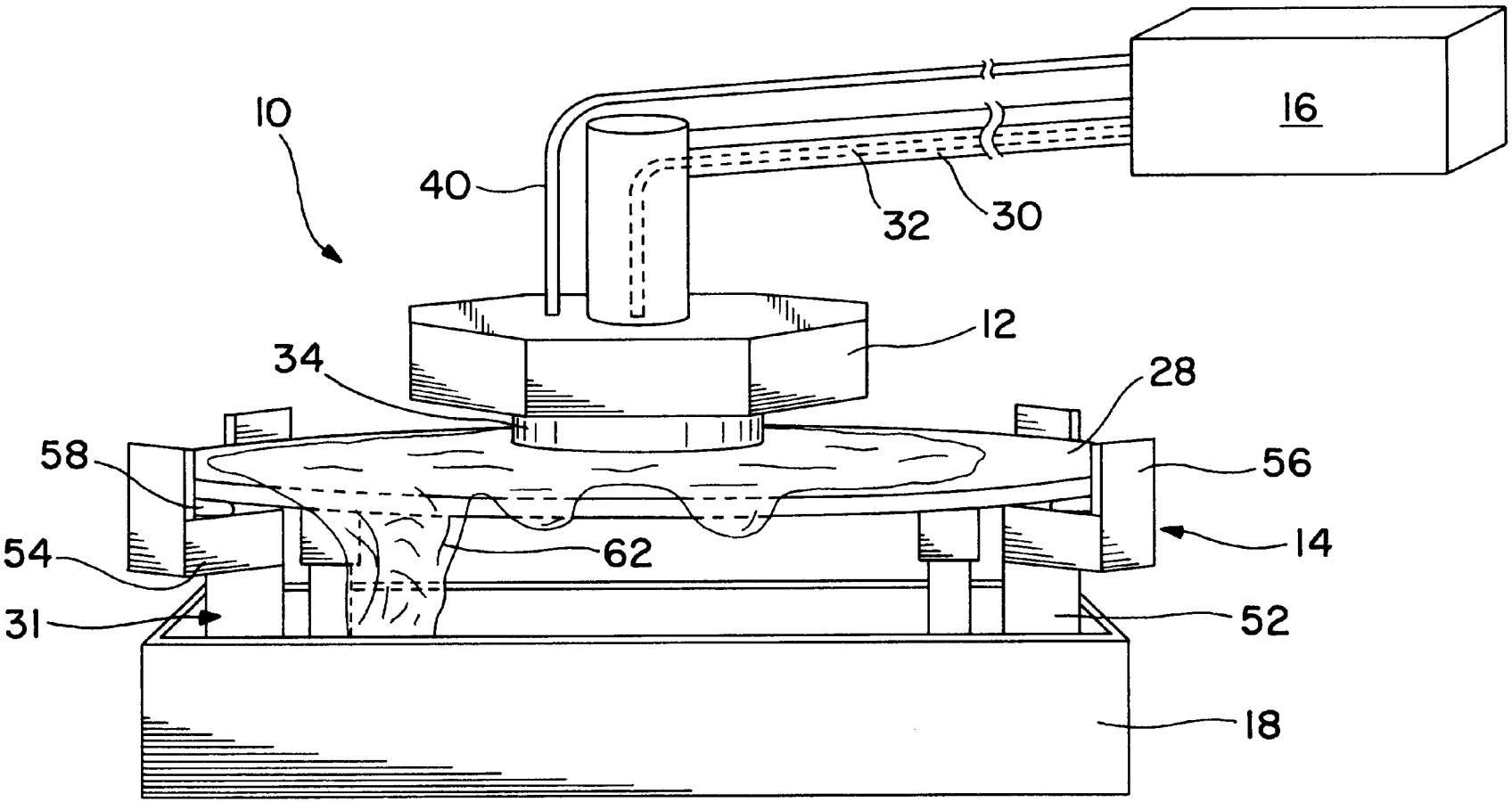
FIG. 1 illustrates a perspective view, in simplified form, of an embodiment of the present invention.

The description contained herein relates to a form of a megasonic cleaning and etching device as presently contemplated. This description, however, is intended to be illustrative only and not limiting as to the scope of the present invention. For example, while the invention will be described in the context of dislodging particulate matter from wafers, the invention is applicable to cleaning, etching, or otherwise treating other items as well.

In the drawings, where like numerals indicate like elements, there is shown a megasonic treatment apparatus 10 in accordance with the present invention. The drawings are schematic in that non-essential structures and elements have been omitted.

As shown in FIG. 1, the apparatus 10 for cleaning or etching wafers comprises: a transducer assembly support 16, a transducer assembly 12, a rotatable wafer support 14 and an optional catch basin 18.

The transducer assembly support 16 supports transducer assembly 12 and moves it both horizontally and vertically (as will be described in more detail below). The transducer assembly support 16 comprises a cantilevered arm 30, from which the transducer assembly 12 is suspended and a signal cable 40 for supplying electrical drive signals to the transducer assembly 12. In a preferred embodiment, the transducer assembly support 16 further comprises a fluid flow conduit 32 for conveying cleaning fluid to the transducer assembly 12.

The term "cleaning fluid" is used in the present invention to generically mean any fluid used for either cleaning or etching, e.g. de-ionized water with a re-ionizing agent, water with ammonium hydroxide, sulfuric acid with peroxide, ozonated water, SC1 (80% sulfuric acid, 20% peroxide), SC2, and diluted hydrofluoric acid. As would be apparent to those skilled in the art, the cleaning fluids listed herein are meant to be illustrative and are not all-inclusive.

The transducer assembly 12 is supported from above by a cantilevered arm 30 attached to the upper portion of the transducer assembly 12. This arrangement permits the transducer assembly 12 to be moved away from the rotatable support 14, so that a wafer 28 can be placed between rotatable support 14 and transducer assembly 12, and the transducer assembly can then be moved back in suspended orientation over the wafer 28. The wafer is shown herein with an identifying number for illustration purposes only to demonstrate the operation of the invention, and is not intended to be of any fixed size or shape.

The rotatable support 14 provides the surface upon which an item to be cleaned, i.e., a wafer 28, is placed. The support 14 rotates the item, in a known manner, at a user-selected rate. The rotatable support 14 comprises at least one wafer support member 31, and further preferably comprises four wafer support members 31, located at 90° intervals around the circumference of the wafer 28.

The optional catch basin 18 is located below the support structure 14, to catch cleaning fluid delivered through transducer assembly 12. The optional catch basin 18 receives cleaning fluid as it flows off the wafer 28. The catch basin 18 may include or be replaced by a drain to carry away the fluid flow and all particles contained therein.

Figure 2:
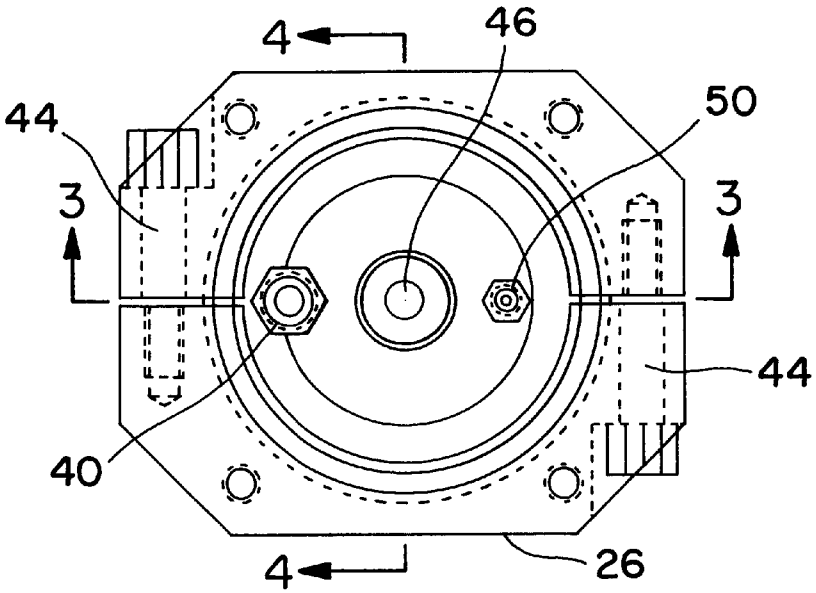
FIG. 2 illustrates a top view of the embodiment of FIG. 1.
Figure 4:
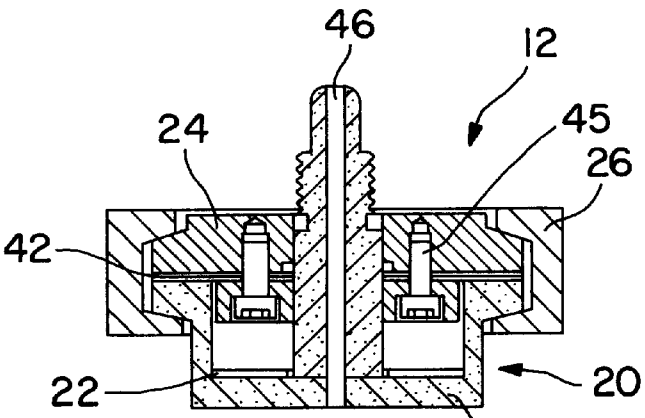
FIG. 4 illustrates a cross-sectional view of the embodiment of FIG. 2 as taken from 4—4.
Figure 3:
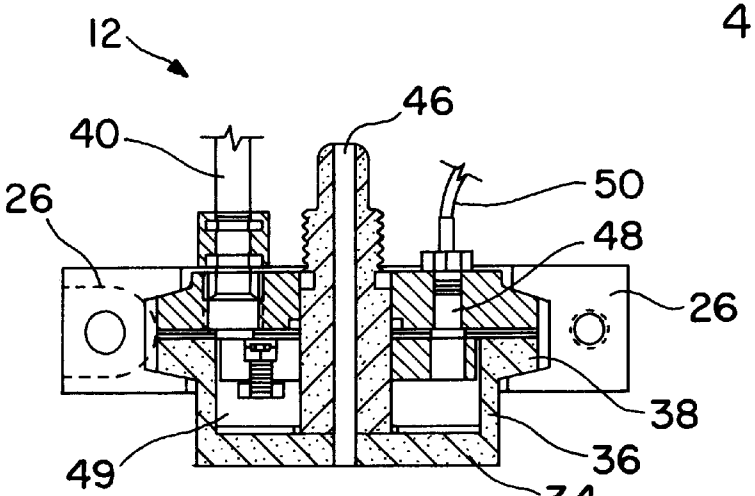
FIG. 3 illustrates a cross-sectional view of the embodiment of FIG. 2 as taken from 3—3.

As shown in FIGS. 2–4, the transducer assembly 12 comprises a megasonic lens 20, at least one piezoelectric transducer element 22 located within the megasonic lens 20, a top plate 24, and at least one collar 26 for locking the megasonic lens 20 and top plate 24 in proper mating position. The transducer assembly 12 converts electrical energy into mechanical energy to create a sonic field, i.e., megasonic waves, in a fluid.

The megasonic lens 20 comprises a bottom or faceplate 34, and a wall 36 extending upwardly from the periphery of the faceplate 34. The faceplate 34 forms the central portion of the megasonic lens for transmitting the mechanical energy generated. In the embodiment shown, the top of the wall 36 has an outwardly extending flange portion 38 that fits flush against the top plate 24 and is beveled to mate with a corresponding complementary bevel in collar 26. In a preferred embodiment the megasonic lens 20 is made of quartz or sapphire. As compared with the metals used in the prior art lens, quartz or sapphire offer good mechanical strength and minimal acoustic attenuation; however, they also advantageously are generally unaffected by most cleaning or etching solutions.

In a preferred embodiment, the faceplate 34 has a thickness which is a multiple of ½ the wavelength of the applied sound energy in the material from which faceplate 34 is made. As one example, for an applied sound energy at 1.536 MHz, the preferred thickness of the faceplate of a quartz lens is 3.8 mm, which is 1½ wavelengths at a frequency of 1.536 MHz.

The top plate 24 fits flush against outwardly extending flange portion 38 of the megasonic lens 20 to seal the interior volume of the megasonic lens 20 from the ambient atmosphere. The top of the top plate 24 is beveled to mate with a corresponding complementary bevel in collar 26. A gasket 42 may be placed between the top plate 24 and flange portion 38 to enhance the seal between the top plate 24 and megasonic lens 20. In the embodiment shown, fasteners 45 secure the gasket 42 tightly between top plate 24 and flange portion 38. See FIG. 4. By "fasteners" is meant bolts, screws and the like that are known to one skilled in the art.

The collar 26 preferably, but not necessarily, includes two halves that engage megasonic lens 20 and top plate 24 between the respective halves in a clamp-like fashion. In the embodiment shown in FIG. 2, the collar 26 consists of two U-shaped portions connected by fasteners 44.

As shown in FIGS. 3 and 4, at least one piezoelectric transducer element 22 is located within the interior 49 of the megasonic lens 20, preferably adjacent to and in acoustic contact with, the faceplate 34. An electrical power source (not shown) produces electrical drive signals that are sent to the transducer assembly 12, via a signal cable 40. The electrical power source would be of a type known to one of ordinary skill in the art. The signal cable 40 carries the electrical drive signals from the power source to the piezoelectric transducer element 22. The piezoelectric transducer element 22 converts the electrical energy into mechanical energy, in the form of vibrations. For example, the electric power source may provide a 1.536 MHz electrical signal that is sent to the piezoelectric element 22, which generates an acoustic wave with a frequency of 1.536 MHz. However, as would be apparent to those skilled in the art, the invention is not limited to a specific frequency. The exemplary frequency is provided only to illustrate one preferred embodiment.

A fluid passageway 46 extends through the transducer assembly 12, permitting cleaning fluid to flow through the transducer assembly 12 onto a wafer 28 positioned below the faceplate 34. In the embodiment shown in FIG. 3, the fluid passageway 46 extends through the center of the top plate 24 and faceplate 34. An additional passageway 48 is provided through the transducer assembly 12 and through the top plate 24, and terminates at the interior 49 of the megasonic lens 20. The passageway 48 provides access to the interior 49 for a purge system 50. The purge system 50 removes any fumes or chemicals from interior 49, maintaining a chemically inert atmosphere. In a preferred embodiment, a nitrogen purge is used to insure that the megasonic lens interior 49 is exposed to only an inert atmosphere.

As shown in FIG. 1, the rotatable wafer support 14 is located below and adjacent to transducer assembly faceplate 34, and provides a support on which a wafer 28 rests. The rotatable wafer support 14 comprises at least one support member 31 having a substantially vertical leg 52 with an outwardly extending shelf 54 at one end of leg 52. A stop member 56 is attached to the outer end of the outwardly extending shelf 54 to hold wafer 28 on wafer support 14. A pad 58 may be attached to the upper portion of the outwardly extending shelf 54 to protect wafers that rest thereon. In the preferred embodiment, four support members 31 are positioned at 90° intervals around the circumference of wafer 28. The support members 31 are attached to a base (not shown) housing a rotating mechanism. The rotating mechanism may be any conventional mechanism, such as a motor or the like, to spin a wafer in known fashion for cleaning or etching wafers. The distance between support members 31 may be adjustable to accommodate different sized wafers 28.

Transducer assembly 12 is supported from above by a transducer assembly support 16, through cantilevered arm 30. The arm 30 is movable in at least reciprocal directions along a radius of a wafer 28 that is supported by support member 14, so that the transducer assembly 12 is moved relative to wafer 28. The arm 30 includes a fluid flow conduit 32, which communicates with fluid passageway 46 to provide fluid to the transducer assembly 12 for cleaning, etching, or other operations.

In a preferred embodiment, the arm 30 moves radially across a wafer 28 in reciprocal fashion as the wafer 28 is rotated. This insures that the entire surface of the wafer 28 is exposed to the faceplate 34 of transducer assembly 12. Because the fluid flows through the transducer assembly 12, moving the transducer assembly 12 over the wafer in a reciprocal fashion produces a more uniform treatment of the wafer. In a preferred embodiment, the horizontal movement of arm 30 is controlled by a means known in the art, e.g., a motor (not shown) of a type known to one of ordinary skill in the art, housed in the transducer assembly support 16.

The height of the transducer assembly 12 above the upper surface of the wafer 28 is adjusted to maximize the energy density generated by the piezoelectric transducer element 22. The height is adjusted to set the optimal energy density, which is based on the various fluid wavelengths and the various wafer sizes. In the preferred embodiment, the vertical adjustment of the transducer assembly 12 is controlled by a means known in the art, e.g., a motor (not shown) of a type known to one of ordinary skill in the art, housed in the transducer assembly support 16.

Figure 5:
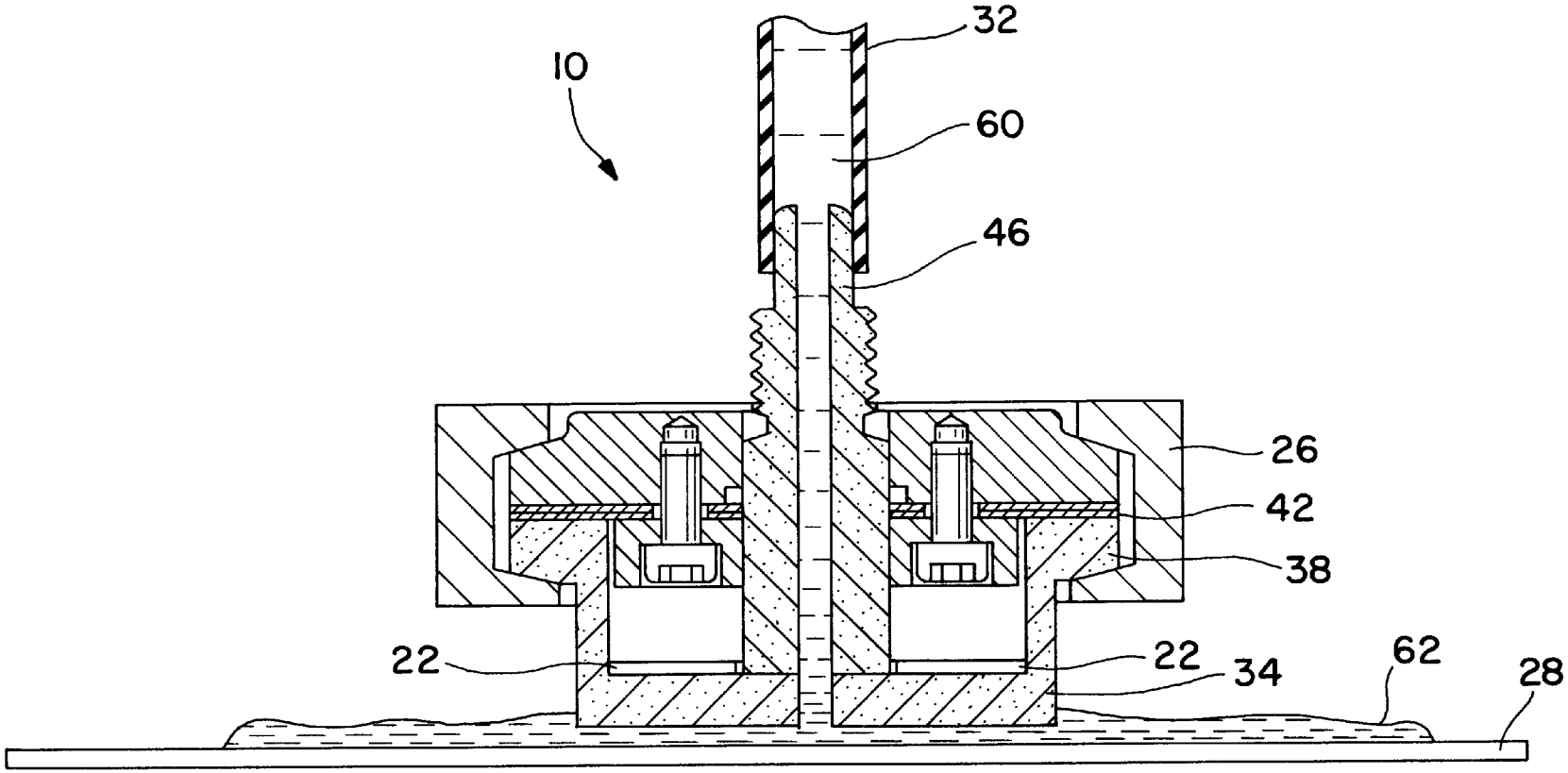
FIG. 5 illustrates a cross-sectional view of the embodiment of FIG. 1 in the fluid delivery mode.

As shown in FIG. 5, when the megasonic treatment apparatus 10 is in operation, user-selected cleaning fluid 60, e.g., de-ionized water with a re-ionizing agent, travels through the fluid flow conduit 32 to the transducer assembly 12. The cleaning fluid 60 passes through transducer assembly 12, by way of fluid passage 46, and exits faceplate 34 at a user-selected fluid flow rate. In a preferred embodiment, the cleaning fluid flow rate is set to 100 cc/min, which is sufficient to maintain a 1 mm thick layer of cleaning fluid 62 applied to a wafer 28 and to carry the dislodged particles from the wafer 28. The cleaning fluid flow rate is in the range of 100–1000 cc/min, more preferably in the range of 100–300 cc/min to reduce chemical consumption, and the most preferred, as shown in the exemplary embodiment, at 100 cc/min.

A layer of fluid 62 forms and spreads out in the gap between faceplate 34 and wafer 28. The height of arm 30 is controlled so that the faceplate 34 maintains contact with fluid layer 62 to excite the fluid by mechanical vibration of the piezoelectric transducer element 22. In the preferred embodiment, the user-selected thickness of the fluid layer 62 is a multiple of ½ the wavelength of the applied sound energy in the user-selected cleaning fluid 60.

Upon activation of the rotatable wafer support 14, the wafer 28 begins to spin at the user-selected rate. An electronic signal is sent via cable 40 to piezoelectric transducer element 22, which converts the electrical energy into megasonic mechanical energy. The mechanical energy vibrates the faceplate 34 at a pre-selected frequency and wavelength. The frequency is in the range of 70 kHz to 3 MHZ, more preferably in the range of 1.2 MHz to 1.8 MHz, and the most preferred, as shown in the exemplary embodiment, 1.536 MHz. The vibration of the faceplate 34 generates a sonic field that excites fluid layer 62.

The cantilevered arm 30 is moved, in a reciprocal manner, along a radial line across the upper surface of wafer 28 as wafer 28 is rotated. The excited fluid layer 62 dislodges small particles from the wafer 28, which float away in the fluid layer 62, off the upper surface of wafer 28, and into the catch basin 18. The cleaning or etching operation continues until the entire surface of the wafer 28 has been exposed to excited fluid for a user-selected time.

The height of the transducer assembly 12 over wafer 28 may be adjusted by moving arm 30 to maximize the effect of the sonic field applied to wafer 28. This insures more effective excitement of the fluid layer 62 is applied to wafer 28 and reduces cleaning/etching times. The distance between the surface of the lens and the wafer is in the range of 0.5 mm to 2.5 mm, more preferably in the range 0.5 mm to 1.5 mm, and the most preferred, as shown in the exemplary embodiment, is 1 mm. For instance, in a preferred embodiment in which lens is quartz, if the fluid is water, which is generally used in cleaning applications, then the distance between the surface of lens and the wafer is preferably set to 1 mm, which is equal to one wavelength of sound in water at 1.536 MHz.

As the wafer is being processed, the interior 49 of transducer assembly 12 may be purged with an inert gas, such as nitrogen, admitted via purge line 50, to insure that the interior 49 of transducer assembly 12 is not exposed to potentially damaging wafer processing chemicals or fumes.

Each and every patent, patent application and publication that is cited in the foregoing specification is herein incorporated by reference in its entirety.

While the foregoing specification has been described with regard to certain preferred embodiments, and many details have been set forth for the purpose of illustration, it will be apparent to those skilled in the art that the invention may be subject to various modifications and additional embodiments, and that certain of the details described herein can be varied considerably without departing from the spirit and scope of the invention. Such modifications, equivalent variations and additional embodiments are also intended to fall within the scope of the appended claims.

What is claimed is:

1. A megasonic wafer treatment device comprising:

a wafer support for supporting and rotating a wafer to be treated;

a fluid supply port for directing a layer of fluid to the surface of the supported wafer;

an electromechanical transducer assembly for converting electrical signals into mechanical vibrations of a pre-selected megasonic frequency and wavelength and applying the vibrations to the surface of the supported wafer through the layer of fluid, wherein the transducer assembly further comprises (i) a sealed lens having an interior which is bounded by a faceplate and a wall extending upward from the periphery of the faceplate, and a plurality of exterior surfaces, wherein at least one exterior surface of the faceplate portion of the lens comprises a planar fluid contact surface, and (ii) an electromechanical transducer which is located in the interior of the lens and placed in vibration transmitting contact with the faceplate, such that the vibrations are transmitted to the fluid contact surface, wherein the faceplate comprises a material, which is inert with respect to the fluid and which has a thickness that is a multiple of the wavelength of the mechanical vibrations; and wherein the fluid supply port is located through a portion of the faceplate.

2. The megasonic wafer treatment device according to claim 1, wherein the lens material is a non-metal.

3. The megasonic wafer treatment device according to claim 2, wherein the non-metal lens material is quartz.

4. The megasonic wafer treatment device according to claim 2, wherein the non-metal lens material is sapphire.

5. The megasonic wafer treatment device according to claim 1, wherein the thickness of the faceplate is equal to a multiple of one-half wavelengths of the mechanical vibrations.

6. The megasonic wafer treatment device according to claim 5, wherein the thickness of the faceplate is one and one-half wavelengths of the mechanical vibrations.

7. A megasonic wafer treatment device according to claim 1, wherein the fluid supply port is in the center of the faceplate.

8. A megasonic wafer treatment device according to claim 1, wherein the electromechanical transducer assembly is supported from above by a cantilevered arm, wherein the arm moves the transducer assembly radially over the supported wafer to cover the entire wafer surface.

9. A megasonic wafer treatment device according to claim 8, wherein the arm further includes height adjustment means, whereby the height of the fluid contact surface above the wafer is adjustable to permit optimization of the effect of the mechanical vibrations of the transducer assembly.

10. A megasonic wafer treatment device according to claim 1, wherein thickness of the fluid layer on the wafer is a multiple of one-half the wavelength of the mechanical vibrations in the fluid.

11. A megasonic wafer treatment device according to claim 1, wherein the fluid supply port extends through the central portion of the transducer assembly.

12. A megasonic wafer treatment device comprising:

a transducer assembly comprising (i) a quartz megasonic lens, wherein the megasonic lens further comprises a sealed interior which is bounded by a faceplate and a wall extending upward from the periphery of the faceplate, and a plurality of exterior surfaces, wherein at least one exterior surface of the faceplate portion of the lens comprises a planar fluid contact surface, and (ii) at least one piezoelectric transducer in acoustic contact with the interior of the faceplate for converting electrical signals into mechanical vibrations of a pre-selected frequency and wavelength, and wherein the thickness of the faceplate is a multiple of one-half the wavelength of the mechanical vibrations in quartz;

a rotatable wafer support positioned below and adjacent to the transducer assembly for supporting a wafer to be treated;

a fluid supply port, for directing fluid to the surface of the supported wafer, wherein the port extends through the central portion of the transducer assembly and the faceplate, so that the fluid forms a layer on the surface of the supported wafer, wherein the thickness of the layer of fluid is a multiple of one-half the wavelength of the mechanical vibrations in the fluid;

a catch basin located below the wafer support;

a cantilevered arm supporting the transducer assembly from above, wherein the arm moves radially over the wafer; and a height adjustment means associated with the arm for adjusting the height of the faceplate above the supported wafer.

13. A method of treating a wafer comprising:

supporting and rotating a wafer to be treated on a wafer support;

directing a layer of fluid to the surface of the supported wafer through a fluid supply port; wherein the thickness of the layer of fluid on the supported wafer is a multiple of ½ wavelength of the mechanical vibrations in the fluid;

sending an electrical signal to an electromechanical transducer assembly, wherein the electrical signal is converted into mechanical vibrations of a pre-selected frequency and wavelength and applying the vibrations to the surface of the supported wafer through the layer of fluid, wherein the transducer assembly comprises (i) a sealed lens having an interior which is bounded by a faceplate and a wall extending upward from the periphery of the faceplate, and a plurality of exterior surfaces, wherein at least one exterior surface of the faceplate portion of the lens comprises a planar fluid contact surface, and (ii) an electromechanical transducer which is located in the interior of the lens and placed in vibration transmitting contact with the faceplate, such that the vibrations are transmitted to the fluid contact surface, wherein the faceplate comprises a material, which is inert with respect to the fluid and which has a thickness that is a multiple of the wavelength of the mechanical vibrations, and wherein the fluid supply port is located in a portion of the faceplate; and exciting the fluid layer in contact with the fluid contact surface to effect treatment on the wafer.

14. The method according to claim 13, wherein the lens material is a non-metal.

15. The method according to claim 14, wherein the non-metal lens material is quartz.

16. The method according to claim 14, wherein the non-metal lens material is sapphire.

17. A method according to claim 13, further comprising supplying the fluid from a fluid supply port in the center of the faceplate.

18. A method according to claim 13, further comprising moving a cantilevered arm which supports the electromechanical transducer assembly radially over the supported wafer to cover the entire wafer surface.

19. A method according to claim 13, further comprising adjusting a height adjustment means in the arm to control the height of the fluid contact surface above the wafer, thereby optimizing energy density in the fluid layer.

20. The method of claim 13, wherein the treatment is cleaning.

21. The method of claim 13, wherein the treatment is etching.

* * * * *

UNITED STATES PATENT AND TRADEMARK OFFICE

CERTIFICATE OF CORRECTION

PATENT NO. : 6,539,952 B2
DATED : April 1, 2003
INVENTOR(S) : Herman Itzkowitz

It is certified that error appears in the above-identified patent and that said Letters Patent is hereby corrected as shown below:

Column 8,
Line 6, after "wafer", insert -- during megasonic treatment --;
Line 18, delete "and a plurality of exterior surfaces,";
Line 22, delete "vibration transmitting" and insert therefor -- direct --;
Line 24, after "surface", insert -- through the faceplate --;
Line 51, delete "cover" and insert therefor -- treat --.

Column 9,
Line 3, delete "and a plurality of exterior surfaces,";
Line 6, delete "acoustic" and insert therefor -- direct --;
Lines 13 and 14, delete "to be treated" and insert therefor -- and rotating during megasonic treatment --;
Line 29, after "of", insert -- megasonically --;
Line 30, delete "to be treated";
Line 31, after "support", insert -- during megasonic treatment --;
Line 39, after "pre-selected", insert -- megasonic --.

Column 10,
Line 5, delete "and a plurality of exterior surfaces,";
Line 10, delete "vibration transmitting" and insert therefor -- direct --;
Line 12, after "surface", insert -- through the faceplate --;
Line 31, delete "cover" and insert therefor -- treat --.

Signed and Sealed this

Twelfth Day of August, 2003

JAMES E. ROGAN
*Director of the United States Patent and Trademark Office*